US006186230B1

(12) United States Patent
Nierode

(10) Patent No.: US 6,186,230 B1
(45) Date of Patent: Feb. 13, 2001

(54) COMPLETION METHOD FOR ONE PERFORATED INTERVAL PER FRACTURE STAGE DURING MULTI-STAGE FRACTURING

(75) Inventor: Dale E. Nierode, Kingwood, TX (US)

(73) Assignee: ExxonMobil Upstream Research Company, Houston, TX (US)

( * ) Notice: Under 35 U.S.C. 154(b), the term of this patent shall be extended for 0 days.

(21) Appl. No.: 09/487,513

(22) Filed: Jan. 19, 2000

Related U.S. Application Data

(60) Provisional application No. 60/116,498, filed on Jan. 20, 1999.

(51) Int. Cl.[7] ..... E21B 43/26
(52) U.S. Cl. ..... 166/250.1; 166/284; 166/308
(58) Field of Search ..... 166/250.1, 308, 166/271, 284

(56) References Cited

U.S. PATENT DOCUMENTS

| | | | | |
|---|---|---|---|---|
| 3,712,379 | | 1/1973 | Hill | 166/297 |
| 3,851,709 | | 12/1974 | Fitch et al. | 166/308 |
| 4,679,629 | * | 7/1987 | Abdo et al. | 166/284 |
| 5,161,618 | | 11/1992 | Jones et al. | 166/308 |
| 5,265,678 | | 11/1993 | Grundmann | 166/308 |
| 5,390,741 | * | 2/1995 | Payton et al. | 166/284 |
| 5,890,536 | | 4/1999 | Nierode et al. | 166/284 |

OTHER PUBLICATIONS

Cipolla: "Hydraulic Fracture Technology in the Ozona Canyon and Penn Sands" *Society of Petroleum Engineers 35196*, pp. 455–466 (1996).

Webster, Goins, Jr. and Berry: "A Continuous Multistage Fracturing Technique", *Journal of Petroleum Technology*, pp. 619–625 (1965).

Von Albrecht, Diaz, Salathiel, and Nierode: "Stimulation of Asphaltic Deep Wells and Shallow Wells in Lake Maracaibo, Venezuela", *10th World Petroleum Congress, PD7*, pp. 55–62 (1979).

Stipp and Williford: "Pseudolimited Entry: A Sand Fracturing Technique for Simultaneous Treatment of Multiple Pays", *Journal of Petroleum Technology*, pp. 457–462 (1968).

Williams, Nieto, Graham, and Leibach: "A Staged Fracturing Treatment for Multisand Intervals", *Journal of Petroleum Technology*, pp. 897–904 (1973).

Feny, Mingsheng: "The Application Research of the Perforation Friction Pressure Equation in the Fracturing Treatment", *Society of Petroleum Engineers*, 26131 (1992).

* cited by examiner

*Primary Examiner*—William Neuder
(74) *Attorney, Agent, or Firm*—Linda A. Kubena; Gary P. Katz

(57) ABSTRACT

This invention provides a method for designing a multiple-stage ball sealer-diverted fracture treatment so that only one set of perforations is fractured by each stage of fluid pumped. It further provides a method for predicting the sequencing in which perforated intervals will fracture during treatment.

16 Claims, 4 Drawing Sheets

COMPLETION METHOD FOR ONE PERFORATED INTERVAL PER FRACTURE STAGE DURING MULTI-STAGE FRACTURING

This application claims the benefit of U. S. Provisional Application No. 60/116,498, filed Jan. 20, 1999.

FIELD OF THE INVENTION

This invention relates a method for designing a multiple-stage fracture treatment used in hydrocarbon producing operations so that only one perforated interval is fractured during each stage by defining the fracture design parameters necessary for restricting each fracture stage to a single interval.

BACKGROUND OF THE INVENTION

When a hydrocarbon-bearing, subterranean reservoir does not have enough permeability or flow capacity for the hydrocarbons to flow to the surface in economic quantities, hydraulic fracturing stimulation is often used to increase the flow capacity. The wellbore penetrating a subterranean reservoir typically consists of a metal pipe (casing) cemented into the original drill hole. Lateral holes (perforations) are shot through the casing and cement to allow hydrocarbon flow into the wellbore. When reserves are believed to be present, but a well completion is unable to flow hydrocarbons at acceptable rates due to low rock flow capacity, hydraulic fracture stimulation is often applied. Hydraulic fracturing consists of injecting viscous fluids (usually shear thinning, non-Newtonian gels or emulsions) into a reservoir at such high pressures and rates that the reservoir rock fails and forms a plane, typically vertical fracture much like the fracture that extends through a wooden log as a wedge is driven into it. Granular material, such as sand, is injected with the later portion of the fracturing fluid to hold the plane fracture open after the pressures are released. Increased flow capacity from the reservoir results from the easier flow path left between grains of the granular material within the plane fracture.

Application of hydraulic fracturing as described above is a routine part of petroleum industry operations as applied to target zones of up to about 60 meters (200 feet) of gross, vertical thickness of subterranean formation. When there are multiple or layered reservoirs to be hydraulically fractured, or a very thick hydrocarbon- bearing formation (over about 60 meters), then alternate treatment techniques are required to obtain treatment of the entire target zone. The methods for improving treatment coverage are known as diversion methods in petroleum industry terminology.

Prior to this invention, methods that have been used (or proposed for use) to provide fracture treatment diversion include mechanical diversion using bridge plugs or sand to isolate fracture intervals, limited entry using a very small number of perforations to maximize wellbore pressure, and diversion by ball sealers. Each of these methods has significant limitations as described below.

In mechanical diversion, the deepest interval is first perforated and fracture stimulated, then the interval is isolated mechanically and the process is repeated in the next interval up. For example, the deepest 30 meters (100 feet) of formation thickness might be perforated, fractured, and propped with sand. A mechanical bridge plug would then be placed within the casing just above the treated interval and the process repeated on the next 30 meters (100 feet). To treat 300 meters (1,000 feet) of formation in this manner would require ten jobs over a time interval of ten days to two weeks with not only multiple fracture treatments, but also multiple perforating and bridge plug running operations. At the end of the treatment process, a wellbore clean-out operation would be required to remove the bridge plugs and put the well on production. The major advantage of using mechanical separation is high confidence that the entire target zone is treated. The major disadvantages are the high cost of treatment and the risk of complications resulting from so many operations on the well. For example, a bridge plug can become stuck in the casing and need to be drilled out at great expense. A further disadvantage is that the required wellbore clean-out operation often damages some of the successfully fractured intervals.

An alternative to using bridge plugs is filling the just fractured interval of the wellbore with fracturing sand, commonly referred to as the Pine Island technique. The sand column essentially plugs off the already fractured interval and allows the next interval to be perforated and fractured independently. The primary advantage is elimination of the problems and risks associated with bridge plugs. The disadvantages are that the sand plug does not give a perfect hydraulic seal and it can be difficult to remove from the wellbore at the end of all the fracture stimulations. Unless the well's fluid production is strong enough to carry the sand from the wellbore, the well may still need to be cleaned out with a work-over rig. As before, additional wellbore operations increase costs, mechanical risks, and risks of damage to the fractured intervals.

Another possible process is limited entry diversion in which the entire target zone of the formation to be treated is perforated with a very small number of perforations, generally of small diameter, so that the pressure loss across those perforations during pumping promotes a high, internal wellbore pressure. The internal wellbore pressure is designed to be high enough to cause all of the perforated intervals to fracture at the same time. If the pressure were too low, only the weakest portions of the formation would fracture. The primary advantage is that there are no inside-the-casing obstructions like bridge plugs or sand to cause problems later. The disadvantage is that limited entry fracturing often does not work well for thick intervals because the resulting fracture is frequently too narrow (the proppant cannot all be pumped away into the narrow fracture and remains in the wellbore), and the initial, high wellbore pressure does not last. As the sand material is pumped, the perforation diameters are eroded to larger sizes that quickly reduce the internal wellbore pressure. The net result can be that not all of the target zone is stimulated.

The problem with failure to stimulate the entire target zone can be addressed by using limited, concentrated perforated intervals diverted by ball sealers. The zone to be treated could be divided into sub-zones with perforations at approximately the center of each of those sub-zones, or sub-zones could be selected based on analysis of the formation to target desired fracture locations. The fracture stages would then be pumped with diversion by ball sealers at the end of each stage. Specifically, 300 meters (1,000 feet) of gross formation might be divided into ten sub-zones of about 30 meters (about 100 feet) each. At the center of each 30 meter (100 foot) sub-zone, ten perforations might be shot at a density of three shots per meter (one shot per foot) of casing. A fracture stage would then be pumped with sand-laden fluid followed by ten ball sealers, one for each open perforation in a single perforation set or interval. The process would be repeated until all of the perforation sets were fractured.

FIG. 1 illustrates the general concept showing perforation intervals 2, 3, and 4 of an example well. In FIG. 1, interval 3 has been fractured and is in the process of being sealed by ball sealers 12 (in wellbore) and 14 (already seated on perforations), after which the wellbore pressure would rise causing another interval to break down. This technique presumes that each perforation interval or sub-zone would break down and fracture at sufficiently different pressure that each stage of treatment would enter only one set of perforations.

The primary advantages of ball sealer diversion are low cost and low risk of mechanical problems. Costs are low because the process can be completed in one continuous operation, usually during just a few hours of a single day. Only the ball sealers are left in the wellbore to either flow out with produced hydrocarbons or drop to the bottom of the well in an area known as the rat (or junk) hole. The primary disadvantage is the inability to be certain that only one set of perforations will fracture at a time so that the correct number of ball sealers are dropped at the end of each stage. In fact, optimal benefit of the process depends on one fracture stage entering the formation through only one perforation set and all other open perforations remaining substantially unaffected during that stage of treatment. Further disadvantages are lack of certainty that all of the perforated intervals will be treated and lack of knowledge of the order in which these intervals are treated while the job is in progress.

Accordingly, there is a need for a fracture treatment design method that can economically reduce the risks inherent in the currently available fracture treatment options for formations with multiple or layered reservoirs or with thickness exceeding about 60 meters (200 feet).

SUMMARY OF THE INVENTION

This invention provides a method for designing the placement, number, size, and treatment of multiple perforated intervals so that only one such interval is fractured during each fracturing stage while at the same time determining the sequence order in which intervals are treated. The inventive method will allow more efficient fracture stimulation of many reservoirs, leading to higher well productivity and higher hydrocarbon recovery than would otherwise have been achieved.

Specifically, the invention comprises a method for designing a multiple-stage ball sealer-diverted fracture treatment of a wellbore penetrating at least one subterranean formation so that sub-zones of the subterranean formation(s) are fractured one at a time by selecting at least two perforation intervals within the subterranean formation(s) and determining a breakdown and fracture propagation pressure for each of the selected perforation intervals. Next, the pressures, as adjusted for the wellbore pressure effects, are evaluated to determine which, if any, of the planned perforation intervals are likely to break down during the same treatment stage, and the selection of perforation intervals is revised if necessary to give sufficient separation in breakdown pressures that no two perforation intervals would break down during the same treatment stage. Then the maximum allowable wellbore net pressure for each perforation interval is determined by finding the minimum difference between the fracture propagation pressure of the expected fracture at that perforation interval and the adjusted breakdown pressure of any other perforation interval having a higher breakdown pressure. Fracture treatment parameters are then selected for each perforation interval, and the resulting wellbore net pressure at each other perforation interval having a higher adjusted breakdown pressure is determined and compared to the maximum allowable wellbore net pressure determined earlier for the same perforation interval. If this comparison indicates that the wellbore net pressure exceeds the maximum allowable wellbore net pressure, the next step would be to modify at least one of the fracture treatment parameters or the location of a perforation interval to achieve a wellbore net pressure less than the maximum allowable wellbore net pressure.

BRIEF DESCRIPTION OF THE DRAWINGS

The present invention and its advantages will be better understood by referring to the following detailed description and the attached drawings in which.

DETAILED DESCRIPTION OF THE INVENTION

The present invention will be described in connection with its preferred embodiments. However, to the extent that the following description is specific to a particular embodiment or a particular use of the invention, this is intended to be illustrative only, and is not to be construed as limiting the scope of the invention. On the contrary, it is intended to cover all alternatives, modifications, and equivalents that are included within the spirit and scope of the invention, as defined by the appended claims.

Figure 1:
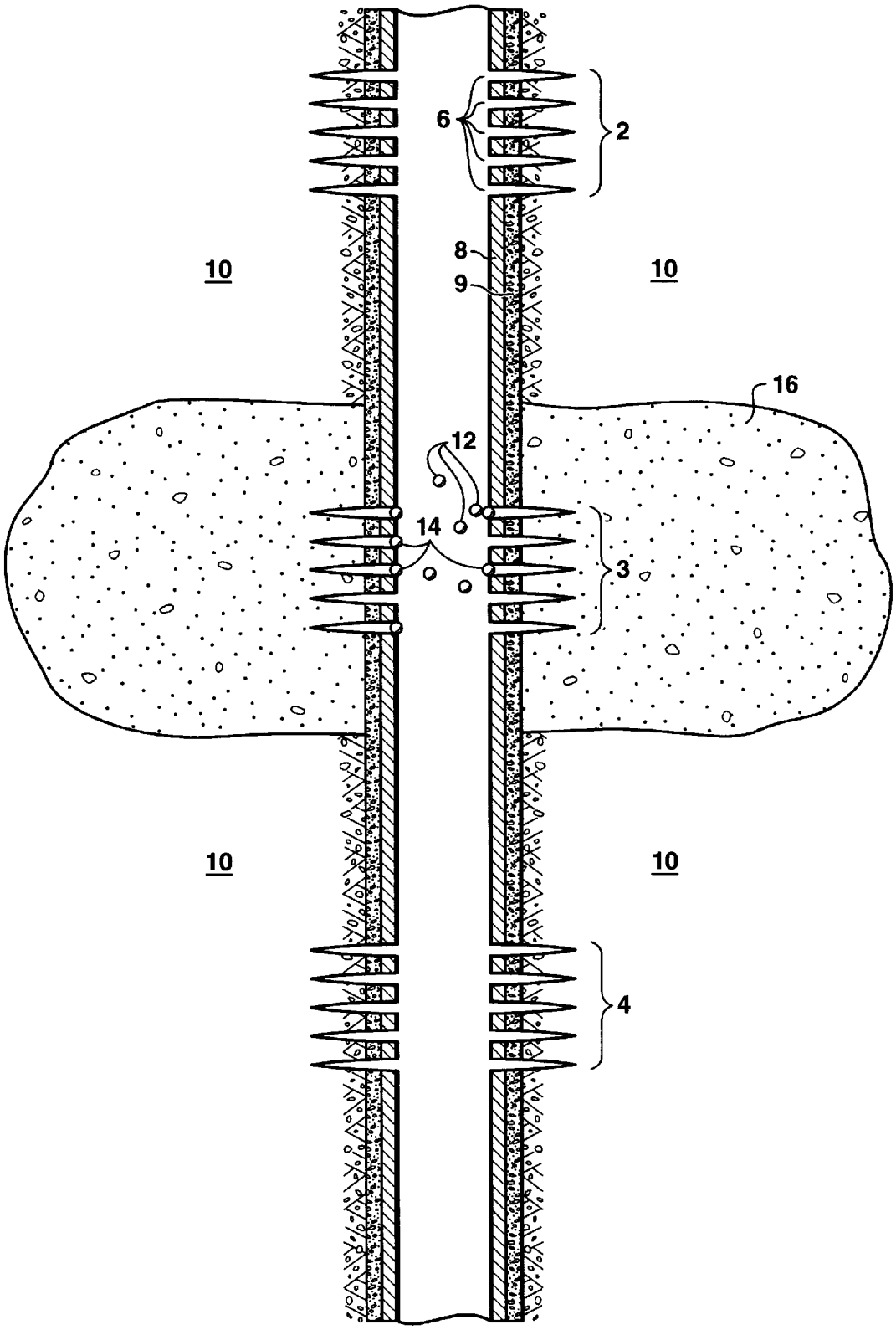
FIG. 1 is a schematic of a wellbore showing ball-sealers being used to seal off the fractured sub-zone.

FIG. 1 shows a schematic of a portion of a wellbore in which three sets (shown as 2, 3, and 4) of perforations 6 are shown penetrating through both the casing 8 and the cement 9 used to secure the casing to allow contact between the wellbore and the subterranean formation 10. Interval 3 has been fractured (with the fracture shown as 16) and is being sealed off by ball sealers 12, some of which have already seated 14 on perforations. An objective of this invention is to select perforation intervals and fracture treatment parameters such that each set of perforations is fractured in a separate stage of treatment and sealed by ball sealers during the fracturing of other intervals.

In one embodiment, the invention is a method to design the specific wellbore completion configuration on a well-by-well basis so that each fracture stage enters the formation (s) through only one set of perforations and that set of perforations alone is sealed off by ball sealers before the next sub-zone is actively being fractured. Although not a requirement, a simplifying constraint utilized in the preferred embodiments is to design the completion such that each set of perforations contains the same number of perforations. Although it is common industry practice to drop more ball sealers than there are perforations in a given set in order to compensate for the risk that one or more ball sealers might fail to seat as it passes the perforations taking fluid, this practice must be balanced against the risk of "stray" ball sealers seating at the wrong perforations. Therefore, according to the present invention, the preferred practice would be to use the same number of ball sealers as there are perforations in the set to be sealed at that time.

To design the completion so that only a single perforation set is fractured during each single stage of a multi-stage fracture treatment, the completion and stimulation treatment parameters must be within a six-dimensional operating window. If any of the parameters are outside of this window, multi-staging will not proceed smoothly and chances are high that not all of the intervals will be treated. It is important to realize that the operating window is a function not only of completion and stimulation parameters that can be easily changed, but also of the specific characteristics of the reservoir rock at each perforated interval. Those skilled in the art will recognize that this window is superimposed on and does not replace the fundamental requirements of successful fracture treatment design and ball sealer diversion design, which are known in the industry.

All single-stages within a ball sealer diverted, multi-stage fracture treatment job should connect with only one perforated interval if the completion and stimulation parameters are within the operating window that is bounded by:

1) Wellbore net pressure being less than the minimum difference between breakdown and fracture pressures of any two unsealed perforated intervals, as described further below;
2) Minimum and maximum perforation diameter;
3) Minimum and maximum number of perforations;
4) Minimum and maximum fracture treatment injection rate;
5) Maximum single-stage pad volume; and
6) Maximum single-stage sand-laden fluid volume.

"Wellbore net pressure" is defined as the wellbore pressure at a given set of open (unsealed) perforations not currently being fractured minus the fracture propagation pressure of the sub-zone currently being fractured through a different set of perforations, and is effectively a combination of the friction effects present during fracturing operations and hydrostatic pressure differences between the two perforation intervals.

The six parameters listed above are evaluated to determine which of the parameter combinations simultaneously keeps wellbore net pressure below the maximum value and yet causes the ball sealers to seat and hold on the perforations. Each of the six parameters in the list above are described in more detail below in terms of preferred ranges and acceptability criteria.

The initial selection of the perforated intervals will generally be based on the objectives of a particular fracture treatment design. In the preferred embodiment of the inventive method, the perforated intervals would be compact and approximately centered within a sub-zone that is approximately the height of the vertical fracture generated by an average stage. A typical perforated interval might contain ten perforations at three shots per meter (one shot per foot) and be centered within a sub-zone that is about 30 meters (100 feet) thick. The three meters (10 feet) of perforations would receive a fracture treatment stage during which the single stage fracture height would grow to about 30 meters (100 feet) tall. Then, ten ball sealers would seat on the perforations and divert the next stage to another perforated interval.

If one blindly followed the general design basis outlined above, a successful multi-stage treatment might result. Each fracture stage might pump into only one perforated interval, and ball sealers might effectively separate stages. On the other hand, numerous factors could cause the multi-stage process to go awry. Two zones could break down simultaneously, and the ten ball sealers then would not effectively divert for the next stage of treatment. On the other hand, ten perforations may be too many or too few to effectively divert between stages. Ten perforations could be too few if the wellbore net pressure becomes too high resulting in fracture of multiple zones during a single stage of treatment. Ten perforations could be too many if the ball sealers do not seat and hold effectively under treating conditions.

As noted above, all single-stages within a ball sealer diverted, multi-stage job should fracture only one perforated interval if the completion and stimulation parameters are within the six-dimensional operating window described below.

1) Wellbore Net Pressure

The wellbore net pressure at any unsealed interval not being fractured in the current stage of treatment must be less than the difference between the breakdown pressure of that unsealed interval and the fracture propagation pressure of the interval then being fractured. In other words, the pressure in the wellbore must be maintained such that the breakdown pressure of another unsealed perforated interval is not reached while fracturing through a given set of perforations. Breakdown and fracture propagation pressures are determined using well measurements and/or calculation methods known to those skilled in the art. Although not the only way of determining the factors needed to implement this invention, and not a limitation of the claims, a recommended calculation method is outlined below.

A density log, preferably from surface to total depth but at least across the range of perforation intervals, and a p-wave and s-wave sonic log run across the range of perforation intervals are processed to yield the minimum horizontal stress versus depth for a relaxed basin (free of external tectonic stresses). The p-wave to s-wave ratio uniquely determines Poisson's ratio at each depth as shown in Equation 1, and the integrated density log yields the overburden gradient versus depth as shown in Equation 2. Equation 3 then estimates the minimum horizontal stress versus depth relationship.

$$\nu = \frac{2 - \left(\frac{V_p}{V_s}\right)^2}{2\left(1 - \left(\frac{V_p}{V_s}\right)^2\right)} \tag{1}$$

where ν is Poisson's ratio, a dimensionless number; $V_p$ is the sonic velocity of p-waves; and $V_s$ is the sonic velocity of s-waves.

$$\sigma_z = c\int_0^D \rho_b dz \tag{2}$$

where $\sigma_z$ is the overburden stress, expressed in MPa (or psi); c is a units conversion factor; $\rho_b$ is the density, expressed in gm/cm$^3$ (or pounds per cubic foot); and z is the depth from the surface, expressed in meters (or feet).

$$\sigma_h = \frac{\nu}{1-\nu}(\sigma_z - p) + p \tag{3}$$

where $\sigma_h$ is the minimum horizontal stress, and p is the pore pressure, both expressed in kPa (or psi).

Fracture breakdown pressures are generally about 5% to 15% greater than the minimum horizontal stress at a given depth due to the stress concentrations around the wellbore caused by the removal of wellbore rock, and fracture propagation pressure is approximately equal to the minimum horizontal stress when fracture length is short (generally a few hundred feet long). For longer fractures, the friction loss along the fracture length should be taken into account.

Figure 2:
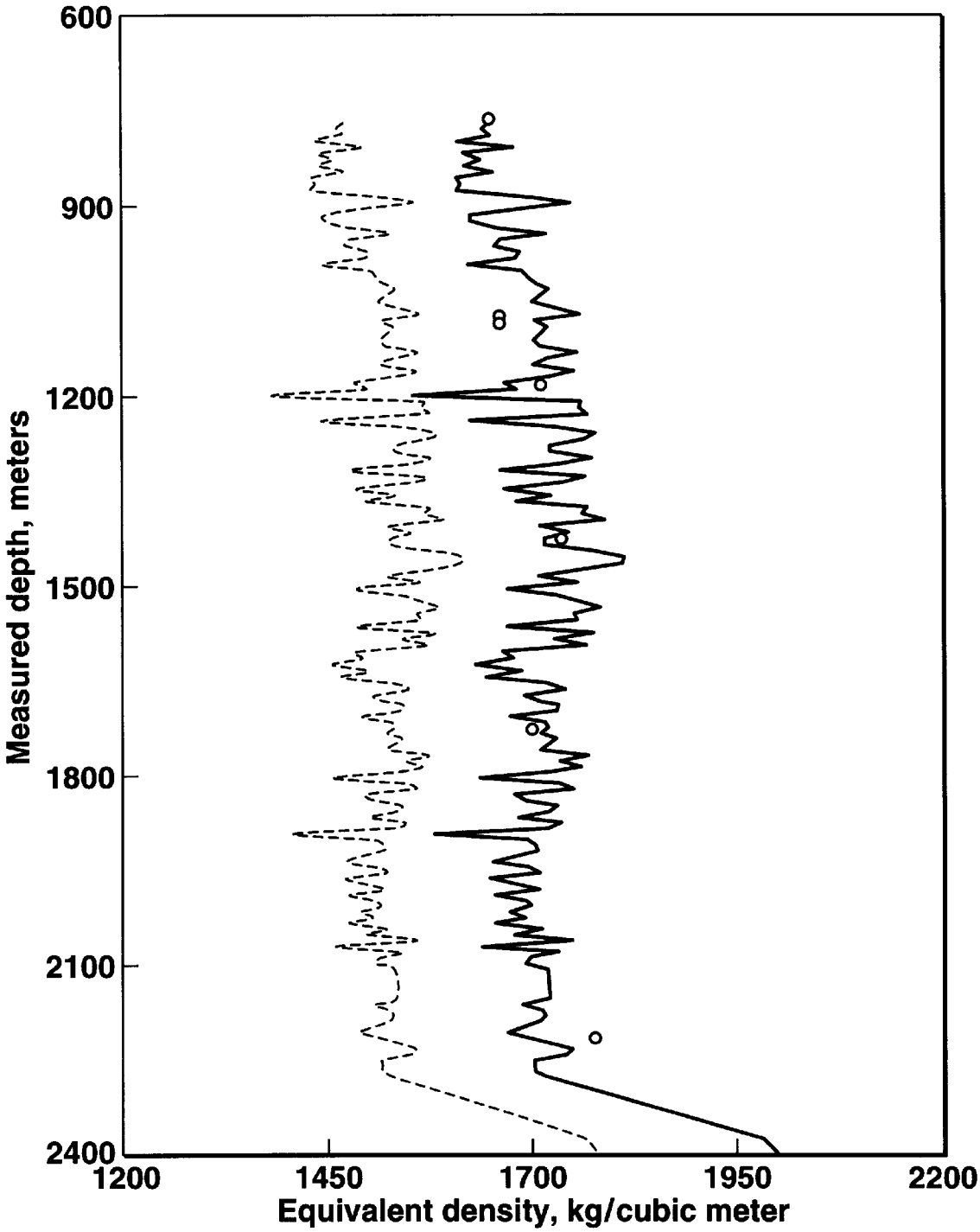
FIG. 2 is a plot showing the fracture breakdown stress determined from leakoff stress test data and the calculated minimum principal horizontal stress for a sample well.

FIG. 2 illustrates the results obtained by plotting the minimum principal horizontal stress calculated from log data (dashed line) and shifting that plot to fit leakoff test data (circles) yielding the fracture breakdown line (shown as a solid line). Leakoff testing consists of increasing the surface pressure with a known density of drilling fluid when a short segment of wellbore is open to the formation and noting the point at which fluid is forced into the formation indicating the onset of fracture breakdown. For reporting purposes, the pressure gradient resulting from the combined effects of the actual fluid density and the surface pressure applied at the breakdown point is converted to an equivalent fluid density at a given depth. Using the fluid density and the depth of the test, the equivalent stress or pressure can similarly be determined.

The calculated breakdown stress in the example shown in FIG. 2 is about 12% higher than the minimum principal horizontal stress, assuming for the purpose of this example that there is a constant relationship over the depths tested. This is a typical result in a relaxed basin where the horizontal stresses result from the overburden stress and the specific Poisson's ratio of the rock within the interval. Those skilled in the art will recognize that a rigorous determination of fracture propagation pressure will include any effects due to tectonic or other stresses as well as variations in rock properties over the target fracture height. They will further recognize that data uncertainties with respect to rock properties should be considered in the application of this invention.

If sufficient leakoff stress test data are not available for the well being treated, data from surrounding wells in similar geologic conditions or even data from other areas with similar geologic conditions may be used to estimate the relationship between horizontal stress and breakdown pressure to determine the breakdown pressure for the perforation intervals being treated. If no data at all are available, an average 10% may be used if the risk of error is appropriately accounted for. In any case, but especially if these estimation techniques are used, the risk of data errors should be considered in determining tolerances as discussed later.

The recommended process is to determine the breakdown pressure across the perforated interval and the horizontal stress across the expected fracture height for each prospective perforated interval. Zones of significant variation in stress across the length of a perforated interval should be avoided in selecting perforation intervals. If there are only minor variations in breakdown stress across a perforated interval, a simplifying step would be to use the average stress across the entire perforated interval. Other possible methods for determining the breakdown pressure to be used for a given interval would be to use 1) the minimum breakdown pressure at any individual perforation within the set, 2) the minimum breakdown pressure at any point across the perforation interval, or 3) the average of the specific breakdown pressures determined at the perforations themselves or within some small range around the perforations, less than the distance between perforations. The choice of method will generally be based on the quality of data available. The order in which the intervals will be fractured is determined by the relative breakdown pressure for each interval including consideration of wellbore pressure effects.

The maximum allowable wellbore net pressure for a given fracture stage is determined by the difference between the fracture propagation pressure for the interval currently being fractured and the breakdown pressure for the next interval to be treated.

2) Perforation Diameter

Calculations of perforation friction pressure loss are done with a range of perforation sizes; although this invention is not limited to any particular perforation diameter, the currently practical range is from about 2.5 to 25 millimeters (0.1 to 1.0 inches). A recommended practice would be to perform calculations over the range of available perforation diameters in 1 to 2 millimeter (0.04 to 0.08-inch) increments covering the range of potential injection rates. The larger the perforation diameter, the less the friction pressure drop will be for a specific flow rate.

3) Number of Perforations

Fracture treatment design calculations are also done as a function of the number of perforations as well as diameter and flow rate. The larger the number of perforations is, the lower the friction pressure loss will be. The preferred range is generally from about five to twenty-five perforations per perforated interval, with ten to fifteen perforations per interval being even more preferred. Although these ranges are preferred, the calculations may indicate in certain circumstances that fewer or more perforations per interval are desirable for a successful fracture treatment. Increasing the number of perforations per interval also increases the number of ball sealers that must be dropped and the importance of carefully handling ball sealer logistics. If the length of the perforation interval is changed, as opposed to changing the perforation density within the previously selected interval, the preferred practice would be to also redetermine the interval's breakdown pressure.

4) Fracture Treatment Injection Rate

Fracture treatment design calculations are also done over a range of injection rates with lower rates giving lower friction pressure losses. Preferred rates generally range from about 0.8 to about 8 cubic meters per minute (5 to 50 barrels per minute), but higher or lower rates may be desirable depending on the number and size of the perforations in a perforated interval.

5) Single-stage Pad Volume

Even when the number and diameter of the perforations are acceptable along with the injection rate, there is a maximum pad size that can be tolerated after which wellbore net pressure rises above the maximum allowable value. This occurs because fracture friction pressure along the fracture length increases as the fracture grows longer. Calculations for pad size determination and friction effects are known to those skilled in the art.

6) Single-stage Sand-laden Fluid Volume

Sand-laden fluid behavior is different from pad volume because erosion enlarges the perforation diameter and this effect somewhat mitigates the increase in net pressure due to fracture friction loss. Perforation erosion is a highly nonlinear effect that increases dramatically as the number of perforations becomes about fifteen or less. Those skilled in the art will be familiar with methods for calculating or estimating perforation erosion effects. Additionally, the hydrostatic pressure effects of the heavier sand-laden fluid throughout the wellbore must be considered.

Additional parameters having minor influence on treatment success include fracturing fluid rheology and the type of proppant used. As will be obvious to those skilled in the art, these parameters will have some influence on the calculations used to determine the parameters listed above and may, in some circumstances, be varied to achieve parameters required by this invention.

The expected wellbore net pressure for a given treatment stage would be calculated for a selected set of fracture treatment parameters and compared to the maximum allowable wellbore net pressure for that stage. If the expected wellbore net pressure exceeds, or preferably is within a selected safety tolerance of, the maximum allowable wellbore net pressure, options include moving or eliminating one or more of the selected perforation intervals and/or adjusting at least one of the fracture design parameters.

Figure 3:
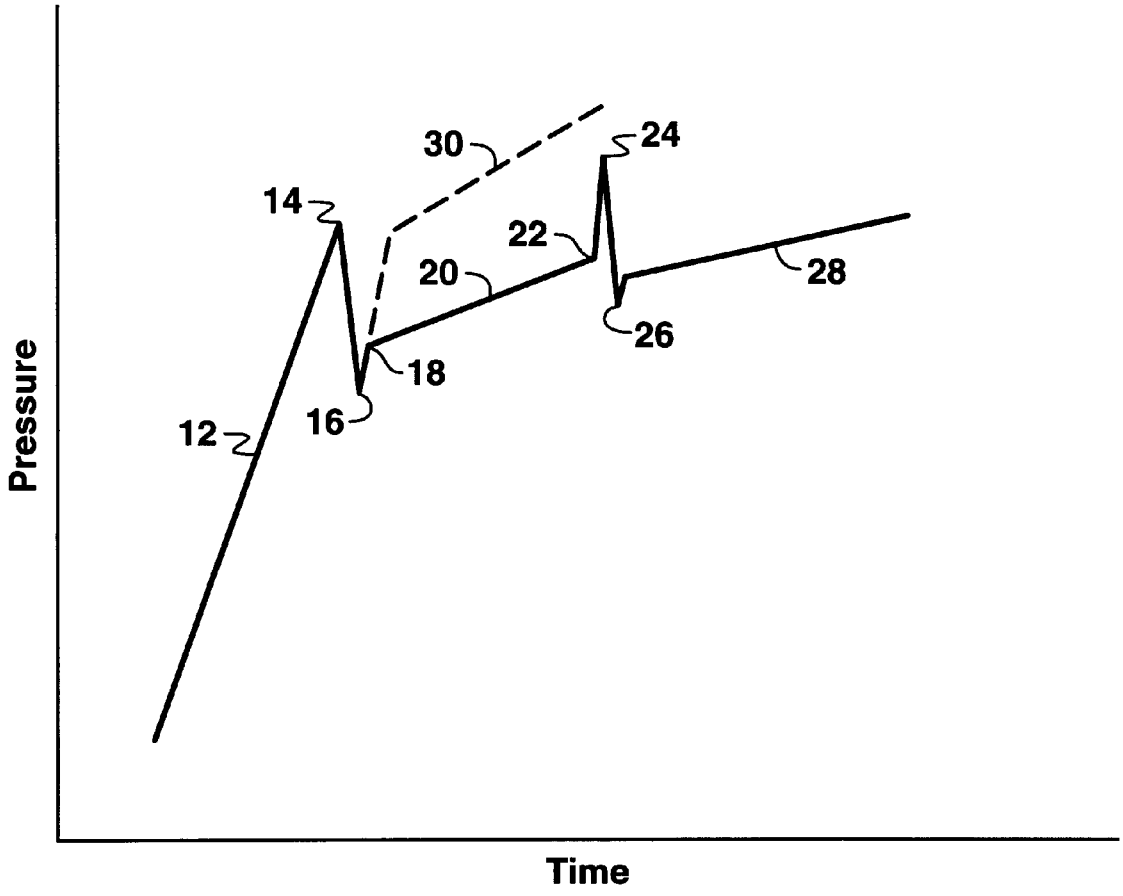
FIG. 3 is a plot of generalized pressure behavior in the wellbore and at the fracture tip during breakdown and propagation of a fracture.

FIG. 3 is an exaggerated characterization of how pressure inside the casing (as measured opposite the perforations taking a particular stage of treatment) would behave during the pumping of two stages separated by ball sealers. As pressure initially rises 12, the pressure level to break down the first interval 14 is achieved. The pressure then almost instantaneously drops to the minimum principal horizontal stress 16 (approximately the fracture propagation pressure for the zone being fractured) and then, again almost instantaneously, rises to the level 18 consistent with the pressure drop through the perforations. As the fracture gets longer, the wellbore pressure rises gradually 20 to account for the friction loss along the fracture length. Note that the pressure can rise to or even above the minimum principal horizontal stress for the next weakest perforation interval without opening its fracture because that pressure is still substantially below the breakdown pressure. After the ball sealers seat 22, then the pressure quickly rises in the wellbore to the level 24 needed to break down the second perforated interval and the process then proceeds similarly for that stage. The peak breakdown spikes are rarely observed because they happen very quickly as the injection rate remains constant at the surface and momentarily goes to zero downhole.

If the perforation friction pressure loss is too high initially, even relatively small subsequent increases in fracture friction loss can raise the wellbore net pressure above breakdown for the next interval as is shown by the dashed line 30 in FIG. 3. Similarly, premature breakdown of the next interval can occur if the fracture friction becomes too large. In both of these adverse situations, breakdown of the next zone could be avoided by using the inventive method to select the number and size of perforations and the rheology of the fracturing fluid. Stage size could be reduced to reduce the fracture friction loss and/or various fracture treatment parameters could be adjusted to reduce the perforation friction losses.

The best mode for practicing the invention occurs when large intervals of subterranean formation(s) need to be stimulated. Although this invention is not limited to a specific number of stages, in the preferred embodiment, a very large interval of subterranean formation(s) would be divided into smaller target zones of about 200 to 600 meters (670–2000 feet) that would each be treated with a separate multiple-stage ball sealer-diverted fracture treatment. For example, a gross interval of 1200 meters (4,000 feet) would preferably be sub-divided into about four 300-meter (1,000 foot) target zones that each would be treated with a ten-stage, ball sealer treatment. The specific location of the perforated intervals within each target zone would be determined by evaluating the sonic and density logs from each well or by other methods known in the industry.

When the calculations are done for the range of practical conditions for a specific multi-stage job, several iterations of calculations are generally done to find the optimal set of parameters. A computer may be used to perform the calculations, preferably with some logic built in to iteratively perform calculations for various job design parameters and, if necessary, for shifted perforation intervals until all of the constraints are met. Ideally, the design parameters for each stage of treatment within a given target zone would be the same, and perforated intervals would be moved or eliminated if necessary to meet the constraints to avoid fracturing more than one interval per stage. Alternatively, it may be deemed preferable in a given situation to vary the fracture treatment parameters by stage to avoid fracturing more than one perforation interval during a single stage. Adjusting the pumping rates, pad volume, or sand loading for one or more stages individually may make it possible to avoid exceeding breakdown pressure of a second perforation interval while fracturing one perforation interval. It may be preferable to adjust the number and diameter of the perforations in a given interval to vary the wellbore net pressure. Those skilled in the art will recognize that such variations increase the complexity and, therefore, the risk associated with a particular job design. Real-time observation or calculation of pressures at one or more of the perforated intervals may allow operating decisions to lengthen or shorten stage size as net pressure is observed.

Figure 4:
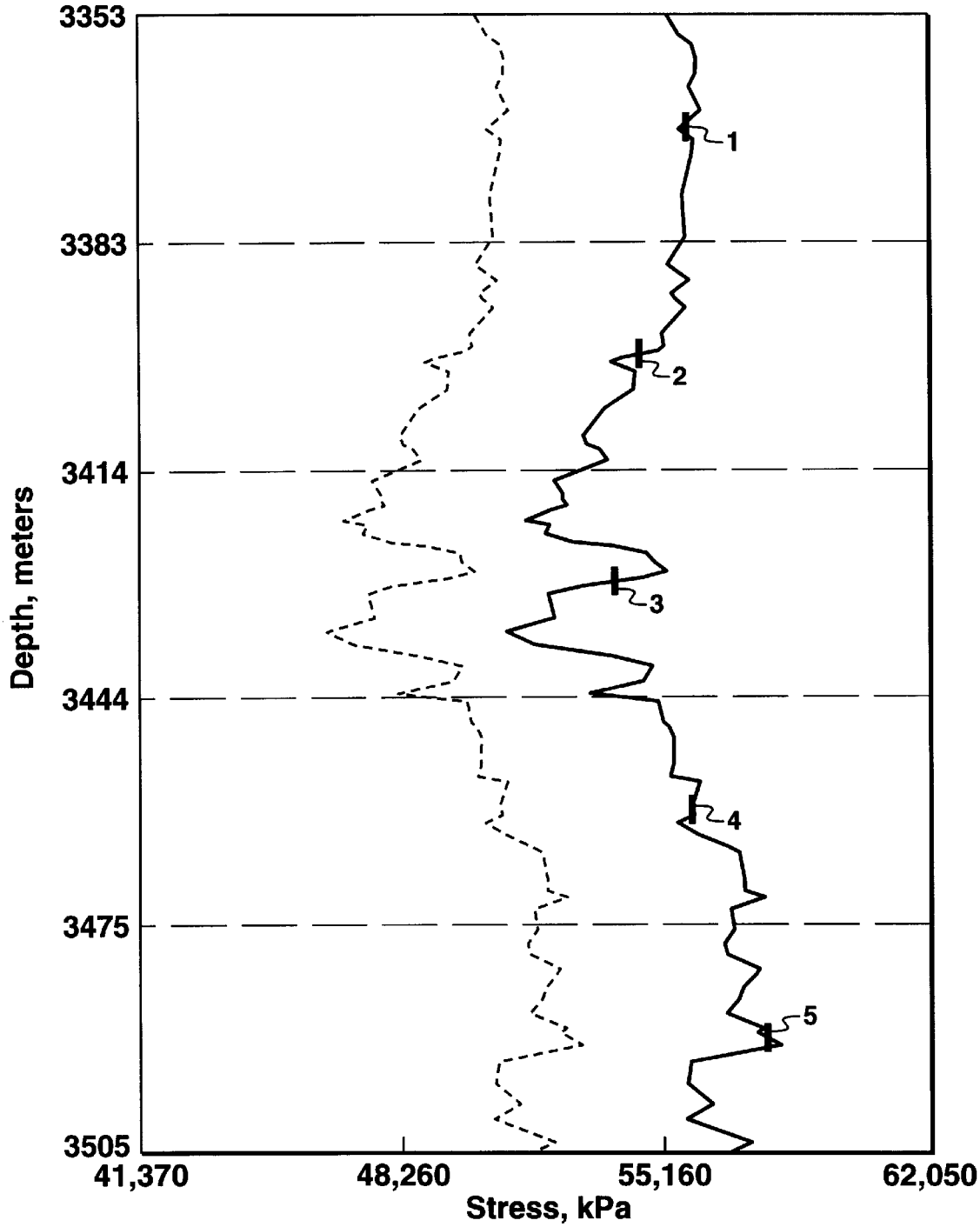
FIG. 4 is a plot of the breakdown and fracture propagation pressures for a sample well, showing the initial target intervals for perforations.

Stress calculations and first-pass perforation interval selections are shown in FIG. 4 for an example well. The first-pass perforation intervals (numbered 1 through 5) were selected to be 30 meters (100 feet) apart with ten perforations in each interval at three shots per meter (one shot per foot). The vertical bars designate the depth of the perforated intervals and the average breakdown stress within each perforated interval. The stress values in FIG. 4 are the minimum principal horizontal stresses (dashed line) and breakdown stresses (solid line), assuming for the purpose of this example that the breakdown stress is 10% higher than the minimum principal horizontal stress. The minimum principal horizontal stress over the height of the fracture (approximate fracture height for each perforation interval is schematically indicated by the horizontal dashed lines in FIG. 4) is assumed to be essentially equal to the fracture propagation stress. Once a fracture is formed and reaches sufficient distance away from the wellbore, the fracture propagation stress is the pressure that the fracture fluid needs to maintain for fracture growth to continue. Average breakdown stress levels for the example well within the perforated intervals are also summarized in Table 1, where the intervals are numbered from 1 (the shallowest) to 5 (the deepest) corresponding to the numbering in FIGS. 1 and 4 for ease of reference.

It can be seen from FIG. 4 that perforation interval 3 at 3427.5 to 3430.5 meters (11,245–255 feet) is in a location where the stress varies too greatly to make it a generally desirable fracture candidate. The stress variation makes it likely that only part of the interval would fracture before one or more other intervals with breakdown pressures falling within the range of the variation also fractured. The assumption that average breakdown pressure can be used over a perforation interval is dependant on the variation within that interval being sufficiently small to avoid overlap with the breakdown pressure range represented by other intervals. Although not applied in this example, a preferred embodiment of the invention would limit the stress variation within a perforated interval to plus or minus one standard deviation from the average. An even more preferred embodiment would apply this limitation to some interval, possibly as much as two meters (about 6 feet), above and below the perforated interval as well, so there would be a safety margin in case the depth measurements during logging or perforating varied slightly. In fully applying the inventive method, the selected perforation intervals would be moved or eliminated to avoid excessive variation within or immediately adjacent to the interval. For the purpose of simply demonstrating the relevant calculations, this step will be eliminated from this example.

TABLE 1

Breakdown Stresses from First-Pass Selection of Completion Intervals

| Interval Number | Perforated Interval Location, ft | Perforated Interval Location, m | Average Breakdown Pressure, psi | Average Breakdown Pressure, kPa |
|---|---|---|---|---|
| 1 | 11,045–055 | 3,366.5–69.5 | 8,108 | 55,903 |
| 2 | 11,145–155 | 3,397.0–3,400.0 | 7,923 | 54,627 |
| 3 | 11,245–255 | 3,427.5–30.5 | 7,824 | 53,945 |
| 4 | 11,345–355 | 3,458.0–61.0 | 8,116 | 55,958 |
| 5 | 11,445–455 | 3,488.5–91.5 | 8,394 | 57,875 |

When the data in Table 1 are sorted by breakdown stress level, a preliminary indication of the stage sequence order is predicted, as shown in Table 2, with wellbore friction and hydrostatic pressure effects initially neglected. It is further seen that the breakdown stress differences between intervals range from 55 to 1,917 kPa (8 to 278 psi). If there were no fluid effects on pressure within the wellbore, the intervals would break down in the order shown in the first column of Table 2 with the next interval being fractured when fracturing pressures are reached within the wellbore, whether or not the ball sealers have already been dropped.

One alternative calculation method for including the effects of hydrostatic wellbore pressure (fluid head) and wellbore friction losses would be to reference the pressures used to a fixed datum point such as, for example, the wellhead or any given set of perforations. The idea is to calculate what the pressure would be at a given set of perforations (often referred to as bottomhole pressure) when the pressure at another set of perforations is known and to compare that calculated pressure to the breakdown pressure at the same set of perforations. Many different calculation methods can be used to make this comparison, and this invention is based on the comparison being made rather than on any specific calculation method. The term "adjusted breakdown pressure" will be used in describing this invention to indicate that some method of adjusting for the wellbore friction loss and hydrostatic pressure effects should be included in the comparison being made at that time to adjust for the difference in depth between the relevant perforation intervals, whether or not a single number representing the adjusted breakdown pressure is ever calculated.

Should two intervals have adjusted breakdown pressures that are substantially equal, there is a risk that they would actually break down in the same stage of treatment. For the purposes of this invention, "substantially equal" will be used to mean that the adjusted breakdown pressures are sufficiently close that the perforated intervals are likely to break down during the same treatment stage. Alternative ways of describing this situation include pressures within the degree of accuracy of pressure measurement or breakdown pressure determination, particularly when the range of breakdown pressures over the perforation intervals have some overlap. Those skilled in the art will recognize that the accuracy of the various measurements and estimations used to determine adjusted breakdown pressure should be considered, and preferably used to determine an appropriate safety tolerance to be applied, in deciding whether intervals should be moved or eliminated to avoid breaking down perforations in more than one perforation set during the initial breakdown pressure spike (shown as 14 and 24 in FIG. 3).

TABLE 2

Initial Prediction of Staging Order from First-Pass Completion Intervals

| Interval Number | Average Breakdown Pressure, psi | Average Breakdown Pressure, kPa | Differential Breakdown Stress, psi | Differential Breakdown Stress, kPa | Wellbore Pressure Effects, psi | Wellbore Pressure Effects, kPa | Net Stress Difference During Staging, psi | Net Stress Difference During Staging, kPa |
|---|---|---|---|---|---|---|---|---|
| 3 | 7,824 | 53,945 | — | — | — | — | — | — |
| 2 | 7,923 | 54,627 | 99 | 682 | 38 | 262 | 137 | 944 |
| 1 | 8,108 | 55,903 | 185 | 1,276 | 38 | 262 | 223 | 1,538 |
| 4 | 8,116 | 55,958 | 8 | 55 | (114) | (786) | (106) | (731) |
| 5 | 8,394 | 57,875 | 278 | 1,917 | (38) | (262) | 240 | 1,655 |

When the dynamic effects of fluid head pressure and friction loss (combined and reported as "Wellbore Pressure Effects") within the wellbore are added to the differential breakdown stress between zones (columns 4 and 5), the last two columns in Table 2 ("Net Stress Difference During Staging") show that intervals 1 and 4 would actually break down in a different order, interval 4 before interval 1. Table 3 shows the revised calculations reflecting the true breakdown ordering. Although the breakdown pressures for intervals 1 and 4 are only 55 kPa (8 psi) apart, once the wellbore pressure effects are taken into consideration, there is a net difference of 724 kPa (105 psi) between breakdown points for the two intervals.

TABLE 3

Revised Prediction of Staging Order from First-Pass Completion Intervals

| Interval Number | Average Breakdown Pressure, psi | Average Breakdown Pressure, kPa | Differential Breakdown Stress, psi | Differential Breakdown Stress, kPa | Wellbore Pressure Effects, psi | Wellbore Pressure Effects, kPa | Net Stress Difference During Staging, psi | Net Stress Difference During Staging, kPa |
|---|---|---|---|---|---|---|---|---|
| 3 | 7,824 | 53,945 | — | — | — | — | — | — |
| 2 | 7,923 | 54,627 | 99 | 682 | 38 | 262 | 137 | 944 |
| 4 | 8,116 | 55,958 | 193 | 1,331 | (76) | (524) | 117 | 807 |

TABLE 3-continued

Revised Prediction of Staging Order from First-Pass Completion Intervals

| Interval Number | Average Breakdown Pressure, psi | Average Breakdown Pressure, kPa | Differential Breakdown Stress, psi | Differential Breakdown Stress, kPa | Wellbore Pressure Effects, psi | Wellbore Pressure Effects, kPa | Net Stress Difference During Staging, psi | Net Stress Difference During Staging, kPa |
|---|---|---|---|---|---|---|---|---|
| 1 | 8,108 | 55,903 | (8) | (55) | 114 | 786 | 106 | 731 |
| 5 | 8,394 | 57,875 | 286 | 1,972 | (152) | (1,048) | 134 | 924 |

Predicting the staging order as shown in Tables 2 and 3 is not essential to the application of this invention, and is shown here for the purpose of clarifying and simplifying the calculations involved. All of the relevant comparisons can be made without the steps of ordering the intervals, especially when a computer is being used to perform the calculations. This ordering does, however, have the benefit of making subsequent fracture design calculations much more straightforward since without the ordering, comparisons may need to be made among all perforated intervals or at least those that would be unsealed at a particular point in the treatment. Additionally, the ability to predict the order in which perforation intervals will fracture is one of the benefits of this invention aside from making the calculations easier.

Since there may be some uncertainties in the determination of fiction pressure losses and/or in the rock properties data, the use of a tolerance factor, preferably in the range of about 70 to 1,400 kPa (about 10 to 200 psi), is recommended to account for the uncertainties in a particular job design. In this example, if the tolerance were around 350 or 700 kPa (about 50 or 100 psi), the next step would be to calculate the impact of fracture propagation pressure and friction effects to check the wellbore net pressure during fracture for any particular fracture treatment design.

If, however, a tolerance of about 1,000 kPa (approximately 150 psi) minimum breakdown pressure difference between perforated zones is applied to the example well, it would be desirable, but not required, to move or eliminate perforation intervals until the desired tolerance was achieved. The results of one possible rearrangement to meet a 1,000 kPa (approximately 150 psi) tolerance are shown in Tables A and 4B (English and metric units respectively)based on moving and eliminating certain perforation interval locations. Note that, for the example shown in Tables 4A and 4B, interval 3 was moved deeper to move away from the area of high variation in breakdown stress and that interval 1 was eliminated because it was too close in stress (within 1000 kPa or 150 psi) to interval 4. Various factors such as engineering or scientific judgment, trial and error, or even a pre-set computer algorithm could be used to decide whether to eliminate interval 1 or interval 4 or to move one or both of the intervals in order to achieve the tolerance desired. If a higher group of intervals is also going to be treated, it may be possible to include interval 1 in the next group fractured. As can be seen from the discussion above, there are likely to be multiple potential configurations.

TABLE 4A

Sample Revised Perforation Intervals and Staging Order Prediction (English Units)

| Original Interval Number | Revised Perforation Interval, ft | Average Breakdown Pressure, psi | Average Fracture Propagation Pressure, psi | Differential Breakdown Stress, psi | Wellbore Pressure Effects, psi | Net Stress Difference During Staging, psi | Maximum Allowable Wellbore Net Pressure, psi |
|---|---|---|---|---|---|---|---|
| 3 | 11,255–265 | 7,582 | 7,033 | — | — | — | — |
| 2 | 11,165–175 | 7,842 | 7,130 | 260 | 34 | 294 | 843 |
| 4 | 11,355–365 | 8,134 | 7,433 | 292 | (72) | 220 | 932 |
| 5 | 11,445–455 | 8,394 | 7,498 | 260 | (42) | 218 | 919 |

TABLE 4B

Sample Revised Perforation Intervals and Staging Order Prediction (Metric Units)

| Original Interval Number | Revised Perforation Interval, m | Average Breakdown Pressure, kPa | Average Fracture Propagation Pressure, kPa | Differential Breakdown Stress, kPa | Wellbore Pressure Effects, kPa | Net Stress Difference During Staging, kPa | Maximum Allowable Wellbore Net Pressure, kPa |
|---|---|---|---|---|---|---|---|
| 3 | 3,430.5–33.5 | 52,276 | 48,491 | — | — | — | — |
| 2 | 3,403.1–06.1 | 54,069 | 49,160 | 1,793 | 236 | 2,029 | 5,814 |
| 4 | 3,461.0–64.0 | 56,082 | 51,249 | 2,013 | (498) | 1,515 | 6,424 |
| 5 | 3,488.5–91.5 | 57,875 | 51,697 | 1,793 | (288) | 1,505 | 6,338 |

In essence, the idea is to keep the pressure increase while pumping an individual stage below that increment needed to break down the next weakest zone, and to design the job such that the adjusted breakdown stresses are sufficiently different so that only one zone breaks down at a time.

In order to prevent multiple perforated intervals from breaking down at the same time, some perforated intervals can be moved to different locations and others removed so that the stress differences during pumping are greater than a tolerance. When the perforated interval locations in Table 1 are altered so that the breakdown stress differences between zones (including fluid head and friction loss effects) are at least 1,000 kPa (about 150 psi), the completion illustrated in Tables 4A and 4B is one possible result.

Going back to the initially selected perforation intervals (see Tables 1 through 3) for demonstration of the next step, the maximum allowable wellbore net pressure calculation is shown in Table 5. Since the perforation intervals have already been ordered based on breakdown stress, the only comparison necessary here is between a given interval's fracture propagation pressure and the next interval's breakdown pressure. Although more complicated, the inventive method can be applied without the steps of ordering the intervals by breakdown pressure as adjusted for wellbore friction and hydrostatic head.

To illustrate the remaining steps in design of a workable completion, the following set of prospective completion parameters are proposed, and checked to see if they are within the design window. The calculations required for basic ball sealer use and fracture treatment design, including fracture and perforation friction losses, are known in the industry and, accordingly, are not described in detail herein.

| | |
|---|---|
| Casing OD | 17.8 cm (7-inches) |
| Number of perforations | 10 per stage |
| Perforation diameter | 0.9 cm (0.35 inches) |
| Ball sealer diameter | 2.22 cm (0.875 inches) |
| Ball sealer density | 1.10 specific gravity |
| Treating rate | 3.2 $m^3$/min (20 bpm) |
| Pad volume | 190 $m^3$ (50,000 gallons) |
| Sand-laden volume | 38 $m^3$ (10,000 gallons) |
| Fracture stage height | 30 m (100 ft) |
| Fracturing fluid | 0.5 kg/$m^3$ (40 lb/1000 gallon) cross-linked water gel |
| Sand concentration | 600 kg sand/$m^3$ fracturing fluid (5 lb/gal) maximum |

TABLE 5A

Revised Prediction of Staging Order from First-Pass Completion Intervals (English Units)

| Interval Number | Average Breakdown Pressure, psi | Net Stress Difference During Staging, psi | Average Propagation Pressure, psi | Delta Breakdown$_2$ Less Propagation$_1$, psi | Wellbore Pressure Effects, psi | Allowable Net Wellbore Pressure, psi |
|---|---|---|---|---|---|---|
| 3 | 7,824 | — | 7003 | — | — | — |
| 2 | 7,923 | 137 | 7211 | 920 | 38 | 958 |
| 4 | 8,116 | 117 | 7400 | 905 | (76) | 829 |
| 1 | 8,108 | 106 | 7375 | 708 | 114 | 822 |
| 5 | 8,394 | 134 | 7498 | 1,019 | (152) | 867 |

TABLE 5B

Revised Prediction of Staging Order from First-Pass Completion Intervals (Metric Units)

| Interval Number | Average Breakdown Pressure, kPa | Net Stress Difference During Staging, kPa | Average Propagation Pressure, kPa | Delta Breakdown$_2$ Less Propagation$_1$, kPa | Wellbore Pressure Effects, kPa | Allowable Net Wellbore Pressure, kPa |
|---|---|---|---|---|---|---|
| 3 | 53,945 | — | 48,284 | — | — | — |
| 2 | 54,627 | 944 | 49,718 | 6,343 | 262 | 6,605 |
| 4 | 55,958 | 807 | 51,021 | 6,240 | (524) | 5,716 |
| 1 | 55,903 | 731 | 50,849 | 4,882 | 786 | 5,668 |
| 5 | 57,875 | 924 | 51,697 | 7,026 | (1,048) | 5,978 |

Again based on uncertainties in pressure and in rock properties, a conservative estimate of the maximum pressure that should be allowed during pumping of the stages shown in Tables 5A and 5B might be to allow a wellbore pressure increase of only about 75% of the lowest allowable net wellbore pressure, which is 5,668 kPa (822 psi) in this example. The allowed wellbore pressure increase using a 75% tolerance would then be about 4,100 kPa (600 psi) for this example. Although wellbore net pressure limitations can be evaluated and designed for individually by stage of treatment, a simplification and the preferred technique would be to limit the pressure increase during fracturing such that the design can be the same for all stages. The preferred alternative would be to set a safety tolerance, preferably at least 350 to 1750 kPa (50–250 psi) or 2–25% of the lowest allowable net wellbore pressure.

Applying friction loss calculation methods known in the industry, the wellbore pressure increase is calculated as follows:

| | | |
|---|---|---|
| Perforation friction loss | 11,583 kPa | (1680 psi) |
| Fracture friction loss | 710 kPa | (103 psi) |
| Total wellbore pressure increase | 12,293 kPa | (1783 psi) |

The combined perforation and fracture friction losses calculated above clearly exceed the difference between the fracture propagation pressure of any zone and the breakdown pressure for the next zone. This means that at least some of the perforations in the next zone would be likely to fracture at the same time. If the number of perforations is increased from 10 to 20 by increasing the shot density without changing the length of the perforation interval (changing the interval length may require redetermining the breakdown pressure), the calculated results are as follow:

| | | |
|---|---|---|
| Perforation friction loss | 2,896 kPa | (420 psi) |
| Fracture friction loss | 710 kPa | (103 psi) |
| Total wellbore pressure increase | 3,606 kPa | (523 psi) |

When interval 3 is being fractured, the expected net wellbore pressure at interval 2 is 3,606 kPa (523 psi) less the 262 kPa (38 psi) in wellbore pressure effects shown in Tables 5A and 5B, for a wellbore net pressure of 3,344 kPa (485 psi), which is significantly less than the difference between fracture propagation pressure for interval 3 (48,284 kPa or 7003 psi) and the breakdown pressure for interval 2 (54,267 kPa or 7,923 psi) and is also well below the allowable 4,100 kPa (600 psi) based on the selected safety tolerance of 25%. Based on known industry calculations, the ball sealers would also seat and hold using this set of treatment parameters, therefore each of the stages would be separate and result in only one set of perforations being fractured in each stage of treatment.

There are other combinations that would work similarly well. For example, with the same parameters above except:

| | |
|---|---|
| Number of perforations | 15 per stage |
| Perforation diameter | 1.3 cm (0.50 inches) |
| Treating rate | 4.8 $m^3$/min (30 bpm) |

the calculated wellbore pressure increase becomes:

| | | |
|---|---|---|
| Perforation pressure loss | 2,779 kPa | (403 psi) |
| Fracture friction | 751 kPa | (109 psi) |
| Total wellbore pressure rise | 3,530 kPa | (512 psi) |

Persons skilled in the art may prefer different methods and assumptions for the various stress and friction loss determinations required for this invention, which may yield some variations in the calculated wellbore pressure rise depending on the method chosen by any given practitioner. Those skilled in the art will, however, be able to quantify the uncertainties associated with the various calculation methods and/or simplifying assumptions that they may choose to use. These variations should have minimal impact if the practitioner applies appropriate safety tolerances to compensate for the accuracy and limitations of any given determination method.

The foregoing description has been directed to particular embodiments of the invention for the purpose of illustrating the invention. It will be apparent to persons skilled in the art that many modifications and variations not specifically mentioned in the examples will be equivalent in function for the purposes of this invention. All such modifications and variations are intended to be within the scope of the present invention, as defined by the appended claims.

What I claim is:

1. A method for designing a multiple-stage ball sealer-diverted fracture treatment of a wellbore penetrating a plurality of perforation intervals in at least one subterranean formation so that said perforation intervals of said at least one subterranean formation are fractured one at a time, said method comprising determining and selecting perforation intervals and fracture treatment parameters such that the wellbore net pressure at any given set of perforations does not increase above the difference between the adjusted breakdown pressure for the portion of the subterranean formation adjacent said given set of perforations and the fracture propagation pressure of the interval then being treated.

2. A method for designing a multiple-stage ball sealer-diverted fracture treatment of a wellbore penetrating a plurality of perforation intervals in at least one subterranean formation so that said perforation intervals of said at least one subterranean formation are fractured one at a time, said method comprising:

a) selecting at least two perforation intervals within said at least one subterranean formation desired to be fractured;

b) determining a breakdown pressure for each of said perforation intervals and adjusting said breakdown pressure for wellbore pressure effects;

c) determining a fracture propagation pressure for the fracture expected to propagate from each of said perforation intervals;

d) if any two perforation intervals have adjusted breakdown pressures that are substantially equal, repeating the selection of perforation intervals so as to cause sufficient separation in breakdown pressures that no two perforation intervals would break down during the same treatment stage;

e) determining the maximum allowable wellbore net pressure for each perforation interval by finding the minimum difference between the fracture propagation pressure of the expected fracture at that perforation interval and the adjusted breakdown pressure of any other perforation interval having a higher adjusted breakdown pressure than the breakdown pressure of the perforation interval associated with said expected fracture;

f) selecting fracture treatment parameters comprising a perforation diameter, a number of perforations, a fracture treatment injection rate, a single-stage pad volume, and a single-stage sand-laden fluid volume for each perforation interval;

g) calculating the resulting wellbore net pressure at each other perforation interval having a higher adjusted breakdown pressure than the adjusted breakdown pressure of the perforation interval for which fracture treatment parameters were selected;

h) comparing the wellbore net pressure calculated in step (g) for a given perforation interval to said maximum allowable wellbore net pressure determined in step (e) for the same perforation interval; and i) if the comparison in step (h) indicates that the wellbore net pressure exceeds said maximum allowable wellbore net pressure, modifying at least one of the fracture treatment parameters or the location of a perforation interval to achieve a wellbore net pressure less than said maximum allowable wellbore net pressure.

3. The method of claim 2 comprising the additional step of ordering the perforation intervals by adjusted breakdown pressure at the depth of each individual perforation interval, said ordering to be performed at any point after step (b) and before step (g).

4. The method of claim 3 further comprising performing comparisons which are called for in steps subsequent to the step after which said ordering was performed only with respect to the perforation interval immediately following in said ordering the perforation interval to which said comparisons are being made.

5. The method of claim 2 comprising the additional step of selecting and applying a safety tolerance for at least one of steps (d), (e), (g), and (h).

6. The method of claim 2 further comprising selecting the fracture treatment parameters to be the same for each of the perforation intervals.

7. The method of claim 2 further comprising the following additional step:

j) if it is not possible to modify the fracture treatment parameters within practical limits to achieve a wellbore net pressure less than the maximum allowable wellbore net pressure, moving or eliminating one of the formation intervals to eliminate the conflict and repeating steps (a) through (j) as necessary.

8. The method of claim 2 further comprising dividing the at least one subterranean formation to be fractured into target zones of approximately 200 to 600 meters (670 to 2000 feet) and performing the steps outlined above separately for each such target zone.

9. The method of claim 2 further comprising using the same number of perforations for each interval.

10. The method of claim 2 further comprising using between 5 and 25 perforations per perforation interval.

11. The method of claim 2 further comprising using the same number of ball sealers as there are perforations in the perforation interval then being treated.

12. The method of claim 2 further comprising using perforations having a diameter less than about 1.0 inches.

13. The method of claim 2 further comprising using a treatment injection rate of approximately 5 to 50 BPM, said treatment injection rate being selected to be consistent with successful seating and holding of the ball sealers.

14. The method of claim 2 further comprising using a density log run at least across the range of perforation intervals and a p-wave and s-wave sonic log run across the range of perforation intervals to determine the fracture propagation pressure for the fracture expected to propagate from at least one of the perforation intervals.

15. The method of claim 2 further comprising using leakoff stress test data from at least one well in similar geologic conditions to determine the breakdown pressure for a perforation interval.

16. The method of claim 2 further comprising dividing the at least one subterranean formation into at least two target zones desired to be fractured and selecting at least one perforation interval within each of said target zones.

* * * * *